US006742953B2

(12) United States Patent
Burden et al.

(10) Patent No.: US 6,742,953 B2
(45) Date of Patent: Jun. 1, 2004

(54) WRITING INSTRUMENT WITH DISPLAY WINDOW

(75) Inventors: Kevin S. Burden, Palm Harbor, FL (US); Arthur R. Hamilton, Jr., Indian Rocks Beach, FL (US); Edwin L. James, St. Petersburg, FL (US); Christopher K. Nelson, Dunedin, FL (US)

(73) Assignee: BIC Corporation, Mildford, CT (US)

( * ) Notice: Subject to any disclaimer, the term of this patent is extended or adjusted under 35 U.S.C. 154(b) by 44 days.

(21) Appl. No.: 10/147,985

(22) Filed: May 20, 2002

(65) Prior Publication Data

US 2003/0138284 A1 Jul. 24, 2003

Related U.S. Application Data

(63) Continuation-in-part of application No. 10/053,854, filed on Jan. 24, 2002, now abandoned.

(51) Int. Cl.[7] ..... B43K 5/12

(52) U.S. Cl. ..... 401/194; 401/195; 401/52; 401/192

(58) Field of Search ..... 401/194, 195, 401/52, 192

(56) References Cited

U.S. PATENT DOCUMENTS

| | | | | |
|---|---|---|---|---|
| 196,270 | A | | 10/1877 | Trask |
| 483,138 | A | | 9/1892 | Covington |
| 488,736 | A | | 12/1892 | King |
| 507,529 | A | | 10/1893 | Doe |
| 1,068,367 | A | | 7/1913 | Roeder |
| 1,305,835 | A | | 6/1919 | Saalburg |
| 1,387,625 | A | | 8/1921 | Stein |
| 1,401,454 | A | * | 12/1921 | Andersen ..... 401/52 |
| 1,544,479 | A | | 6/1925 | Penn |
| 1,551,530 | A | | 9/1925 | Adams |
| 1,655,365 | A | | 1/1928 | Gurtov |
| 1,683,242 | A | | 9/1928 | Deister, Jr. |

(List continued on next page.)

FOREIGN PATENT DOCUMENTS

| | | |
|---|---|---|
| DE | 3334005 A1 | 4/1985 |
| FR | 2 563 645 A1 | 10/1985 |
| FR | 2 776 960 A1 | 10/1999 |
| GB | 2 321 434 A | 7/1998 |
| JP | 7-290876 | 11/1995 |
| JP | 8-169196 | 7/1996 |
| JP | 9-39466 | 2/1997 |
| JP | 10-6682 | 1/1998 |
| JP | 2001-219689 | 8/2001 |
| WO | WO 99/51447 | 10/1999 |

*Primary Examiner*—Gregory L. Huson
*Assistant Examiner*—Huyen Le
(74) *Attorney, Agent, or Firm*—Jones Day

(57) ABSTRACT

A writing instrument having a display window for displaying images from inside the barrel or body member of the writing instrument. The display window is formed by applying a wrap element having a hole therethrough to a transparent portion of the body member. A writing instrument having a locating mark thereon for facilitating accurate, efficient assembly of a writing instrument. More particularly, the locating mark may be disposed on a wrap element according to a predetermined positional relationship with respect to at least one feature or component of the writing instrument.

33 Claims, 5 Drawing Sheets

U.S. PATENT DOCUMENTS

| | | | | |
|---|---|---|---|---|
| 1,787,889 | A | | 1/1931 | White |
| 1,806,580 | A | | 5/1931 | Barth |
| 1,830,102 | A | | 11/1931 | Felsenthal |
| 1,859,524 | A | | 5/1932 | Nicolet |
| 1,885,541 | A | | 11/1932 | O'Keefe |
| 1,925,844 | A | | 9/1933 | Moll 40/108 |
| 1,965,068 | A | | 7/1934 | Chesler 40/68 |
| 2,067,466 | A | | 1/1937 | Thomas 120/83 |
| 2,111,518 | A | | 3/1938 | Wallace 40/108 |
| 2,158,431 | A | | 5/1939 | Sanders 35/77 |
| 2,167,465 | A | | 7/1939 | Sell 120/34 |
| 2,191,662 | A | | 2/1940 | Huffaker 24/95 |
| 2,237,883 | A | | 4/1941 | Lipic 41/10 |
| 2,262,818 | A | | 11/1941 | Reese 40/68 |
| 2,264,194 | A | | 11/1941 | Wuestman 40/19 |
| 2,272,139 | A | | 2/1942 | Tapner 120/9 |
| 2,339,514 | A | | 1/1944 | Ponath 40/19 |
| 2,347,144 | A | | 4/1944 | Wilson 40/19 |
| 2,388,252 | A | | 11/1945 | Crane 33/107 |
| 2,445,170 | A | | 7/1948 | Gonczi 40/108 |
| 2,475,934 | A | | 7/1949 | Wuestman 40/19 |
| 2,502,328 | A | | 3/1950 | Kuhn 41/16.5 |
| 2,504,076 | A | | 4/1950 | Lindblom 40/68 |
| 2,574,561 | A | | 11/1951 | Hagel 40/28 |
| 2,595,153 | A | | 4/1952 | Malmgren 235/87 |
| 2,646,220 | A | | 7/1953 | Weiser 235/87 |
| 2,702,439 | A | | 2/1955 | Swensson 40/108 |
| 2,751,700 | A | | 6/1956 | Danjczek 40/68 |
| 2,777,636 | A | | 1/1957 | Weiser 235/87 |
| 2,896,348 | A | | 7/1959 | Herne 40/19 |
| 2,971,283 | A | | 2/1961 | Parker 40/334 |
| D191,554 | S | | 10/1961 | Bodor D74/17 |
| 3,093,921 | A | | 6/1963 | Petersen 40/334 |
| 3,123,291 | A | | 3/1964 | Madry 235/87 |
| 3,196,839 | A | | 7/1965 | Bertoglio et al. 120/42.03 |
| 3,220,134 | A | | 11/1965 | Muller et al. 40/335 |
| 3,250,033 | A | | 5/1966 | Siegel 40/334 |
| 3,315,395 | A | | 4/1967 | Kirklen 40/334 |
| 3,343,292 | A | | 9/1967 | Jørgensen 40/334 |
| 3,343,293 | A | | 9/1967 | Kirklen 40/334 |
| 3,394,480 | A | | 7/1968 | Russell 40/336 |
| 3,427,113 | A | | 2/1969 | Bourbon 401/112 |
| 3,510,977 | A | | 5/1970 | Hechtle 40/334 |
| 3,531,885 | A | | 10/1970 | Dablo 40/335 |
| 3,551,064 | A | | 12/1970 | Bartner 401/96 |
| 3,558,234 | A | | 1/1971 | Kranich 401/112 |
| 3,738,037 | A | | 6/1973 | Daley 40/68 |
| 3,785,076 | A | | 1/1974 | Swensson 40/335 |
| 3,810,325 | A | | 5/1974 | Köper 40/335 |
| 3,833,307 | A | | 9/1974 | Kapilow 401/195 |
| 3,887,270 | A | | 6/1975 | Lazarus et al. 350/241 |
| D236,271 | S | | 8/1975 | Herczog |
| 4,037,343 | A | | 7/1977 | Lonsmin 40/334 |
| 4,136,876 | A | | 1/1979 | Kaplan 273/138 R |
| 4,207,695 | A | | 6/1980 | Penza, Jr. 40/334 |
| 4,292,750 | A | | 10/1981 | Zuffellato 40/334 |
| 4,343,559 | A | | 8/1982 | Silver 401/109 |
| 4,381,615 | A | * | 5/1983 | Lonsmin 40/334 |
| 4,526,371 | A | | 7/1985 | Venditti 273/148 R |
| D280,215 | S | | 8/1985 | Huang D19/36 |
| 4,541,630 | A | | 9/1985 | Dirks 273/144 B |
| 4,585,364 | A | | 4/1986 | Liaw 401/195 |
| 4,603,993 | A | | 8/1986 | Jung 401/195 |
| D289,424 | S | | 4/1987 | Huang D19/36 |
| 4,768,040 | A | | 8/1988 | Pipkin et al. 346/14 R |
| 4,798,016 | A | | 1/1989 | Venditti et al. 40/334 |
| 4,801,145 | A | | 1/1989 | Arevalo 273/143 R |
| 4,948,284 | A | | 8/1990 | Lingott 401/195 |
| 4,984,494 | A | | 1/1991 | Yang 84/474 |
| 4,991,988 | A | | 2/1991 | Snell et al. 401/111 |
| 5,016,881 | A | | 5/1991 | Lindsey 273/138 A |
| 5,028,764 | A | | 7/1991 | Kuhlengel 235/64 |
| 5,145,272 | A | | 9/1992 | Keil 401/112 |
| D403,017 | S | | 12/1998 | Barrozo D19/36 |
| D426,263 | S | | 6/2000 | Sekine et al. |
| D426,573 | S | | 6/2000 | Sekine et al. |
| 6,129,470 | A | | 10/2000 | Fang 401/52 |
| 6,171,005 | B1 | | 1/2001 | Kuo 401/195 |
| 6,227,734 | B1 | | 5/2001 | Kageyama et al. 401/104 |
| 6,287,036 | B1 | | 9/2001 | Keda et al. 401/194 |
| 6,375,376 | B1 | * | 4/2002 | Hsu 401/247 |
| 6,386,780 | B1 | | 5/2002 | Brummernhenrich 401/192 |

* cited by examiner

WRITING INSTRUMENT WITH DISPLAY WINDOW

CROSS-REFERENCE TO RELATED APPLICATION

This is a continuation-in-part of application Ser. No. 10/053,854, filed Jan. 24, 2002, now abandoned which is incorporated by reference in its entirety herein.

FIELD OF THE INVENTION

The present invention relates generally to a writing instrument having a display window on its barrel or body. More particularly, the present invention relates to a writing instrument wherein a display window on the body of the writing instrument is used to display images from inside the body.

The present invention further relates to a writing instrument having a locating stripe or mark thereon for facilitating accurate, efficient assembly of a writing instrument.

BACKGROUND OF THE INVENTION

Writing instruments have been used in the past for displaying images or messages. U.S. Pat. No. 3,315,395, issued to George W. Kirklen, discloses a writing instrument having a display feature. The writing instrument described therein comprises an opaque barrel having a window for displaying advertising or other indicia mounted inside the barrel. The barrel is hollow and has a conventional cartridge mounted therein. A sleeve located inside the barrel surrounds the cartridge and bears display notations or indicia on its exterior surface. The indicia are arranged to show through the window.

Two types of windows have typically been used in prior art writing instruments. In a first type, an open hole exists in the barrel. This first type of window may be susceptible to dust and debris, which may enter the barrel through the hole and may accumulate inside the writing instrument. In a second type of window, a piece of transparent plastic material is inset into an opening in the barrel. While this second type of window may generally be less susceptible to dust and debris than the first type, insetting the separate window into the barrel requires (1) the production of the separate window piece, and (2) the subsequent application of the piece to the body. Such additional steps can significantly increase the cost of production.

Other windows for writing instruments have been created wherein the window is neither a hole nor a separate piece of transparent material formed into the body. For example, windows for viewing the ink level of a free-ink pen have been created with a transparent barrel or body having a wrap disposed about the transparent body. The wrap may generally comprise (1) an opaque colored portion, and (2) a transparent portion for creating a window. The transparent portion may be surrounded by a differently colored portion of the wrap distinguishing a window (e.g., a light colored boundary between a transparent window portion and a darker opaque colored portion). Therefore, the window portion of such a writing instrument includes two layers of material: (1) the transparent portion of the wrap; and (2) the transparent barrel.

When such a wrap is used to create a window, consideration must be made of certain critical characteristics of the wrap. For example, if the transparent portion of the wrap is not exactly colorless, the display window might be inappropriately discolored. Further, application of the wrap to the outer surface of a writing instrument body is likely to create air bubbles under the transparent portion of the wrap, thereby disturbing the appearance of the window. Moreover, because the transparent wrap material may have a different index of refraction than the transparent body material, application of the wrap to the body might cause the appearance of the image shown through the window to be distorted. Such considerations become more significant when text or detailed figures, rather than a pen's ink level, are to be displayed from inside the body. In addition, when text or detailed images are to be displayed, proper alignment of the images with the window becomes critical.

SUMMARY OF THE INVENTION

The present invention relates generally to a writing instrument having a transparent display window on its barrel or body member, wherein the display window is created by applying a wrap element having an opening therethrough to a transparent portion of the body member. The opening in the wrap element, in combination with the transparent portion of the body member, defines a windowed portion of the writing instrument.

According to one aspect of the present invention, a display member may be mounted inside the body member. The display member may have a visual image thereon. Further, the display member may be configured and disposed to display the visual image through the windowed portion of the writing instrument. In one embodiment, the display member may be movably mounted inside the body member. For example, the display member may be rotatably mounted inside the body member. The writing instrument may further have an advancing mechanism operatively associated with the body member, wherein the advancing mechanism is configured and disposed to move the display member upon activation of the advancing mechanism. For example, the advancing mechanism may be configured and disposed to rotate the display member. In one embodiment, an actuating mechanism is provided for moving a writing element into and out of a writing position. The actuating mechanism may be configured and disposed to also serve as the advancing mechanism for moving the display member.

The present invention also relates to a method for forming a writing instrument comprising a plurality of components, including, for example, a body member, a windowed portion on the body member, and a first component within the body member. The first component may be viewable through the windowed portion. The method may involve (a) aligning the first component with respect to a second component of the writing instrument according to a predetermined positional relationship between the first component and the second component and (b) aligning the second component with respect to the windowed portion according to a predetermined positional relationship between the second component and the windowed portion so that the windowed portion and the first component are aligned with respect to each other.

The present invention further relates to a writing instrument having a locating mark thereon for enabling accurate and efficient assembly of the writing instrument. The locating mark is disposed on the writing instrument according to a predetermined positional relationship with respect to at least one feature or component of the writing instrument. In one embodiment, a writing instrument has a wrap element disposed about its body member. A locating stripe or mark is disposed on the wrap element according to a predetermined positional relationship with respect to at least one feature or component of the writing instrument.

According to one aspect of the present invention, the locating mark may be disposed on the wrap element according to a predetermined positional relationship with respect to a clip mounted on the writing instrument. In another embodiment, the locating mark may be disposed on the wrap element according to a predetermined positional relationship with respect to an opening in the wrap element. In a further embodiment, the locating mark may be disposed on the wrap element according to a predetermined positional relationship with respect to a visual image on a display member mounted inside the body of the writing instrument.

The present invention further relates to a writing instrument, wherein the display member has a locating mark thereon. The locating mark may be disposed on the display member according to a predetermined positional relationship with respect to at least one feature or component of the writing instrument.

The present invention further relates to a method for forming a writing instrument, wherein a wrap element and a body member are provided. A locating mark is formed on the wrap element according to a predetermined positional relationship with respect to at least one feature or component of the writing instrument. Subsequently, the writing instrument is assembled using the locating mark to position the wrap and the at least one feature or component of the writing instrument according to the predetermined positional relationship. In one embodiment, the locating mark is formed by creating an opening, such as a hole or slot, in the wrap element. In a further embodiment, the writing instrument is assembled according to a predetermined positional relationship between the locating mark and a clip.

These and other features and advantages of the present invention will be readily apparent from the following detailed description of the invention, the scope of the invention being set out in the appended claims.

BRIEF DESCRIPTION OF THE DRAWINGS

The detailed description of the present invention will be better understood in conjunction with the accompanying drawings, wherein like reference characters represent like elements, as follows.

DETAILED DESCRIPTION OF THE INVENTION

Exemplary writing instruments embodying the principles of the present invention are shown throughout the drawings and will now be described in detail. In the following description of various embodiments of the present invention, similar elements or components thereof are designated with reference numbers having the same last two digits; redundant description is omitted.

FIGS. 1–5 depict an exemplary writing instrument 10 formed according to one embodiment of the present invention in which an internal element of writing instrument 10 is viewable through the body member 12 thereof. Writing instrument 10 thus has a transparent body member 12. Body member 12 may be formed of various types of materials, such as transparent molded or extruded plastic or the like. Accordingly, body member 12 may be formed of clear transparent material, or body member 12 may be formed of colored, tinted, sparkling, or otherwise transparent material.

Figure 6:
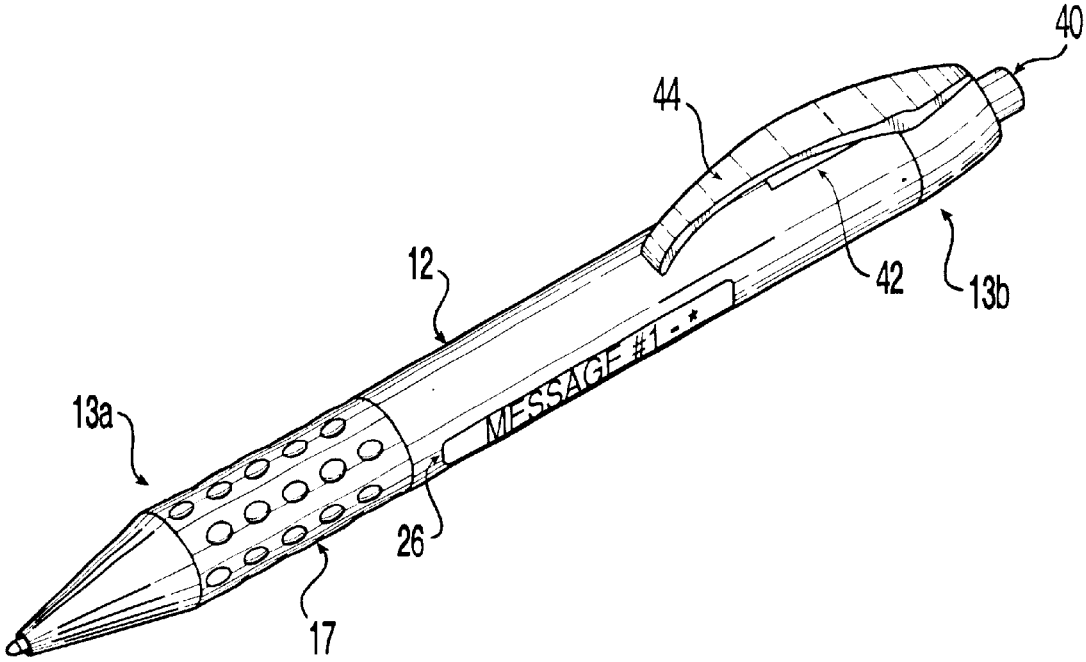
FIG. 6 is a perspective view of a writing instrument formed in accordance with the present invention and having a grip area.

In alternative embodiments, body member 12 may comprise one or more opaque sections and one or more transparent sections. For example, body member 12 may comprise an opaque cylinder having a transparent portion between a first end 13*a* and a second end 13*b* of body member 12. In the following description, first end 13*a* will be referred to as distal end 13*a*. Similarly, second end 13*b* will be referred to as proximal end 13*b*. It should be understood that the terms "distal" and "proximal" are words of convenience and are not to be construed as limiting terms. As shown in FIG. 6, body member 12 may have a grip area 17 on body member 12 near distal end 13*a*.

Figure 4:
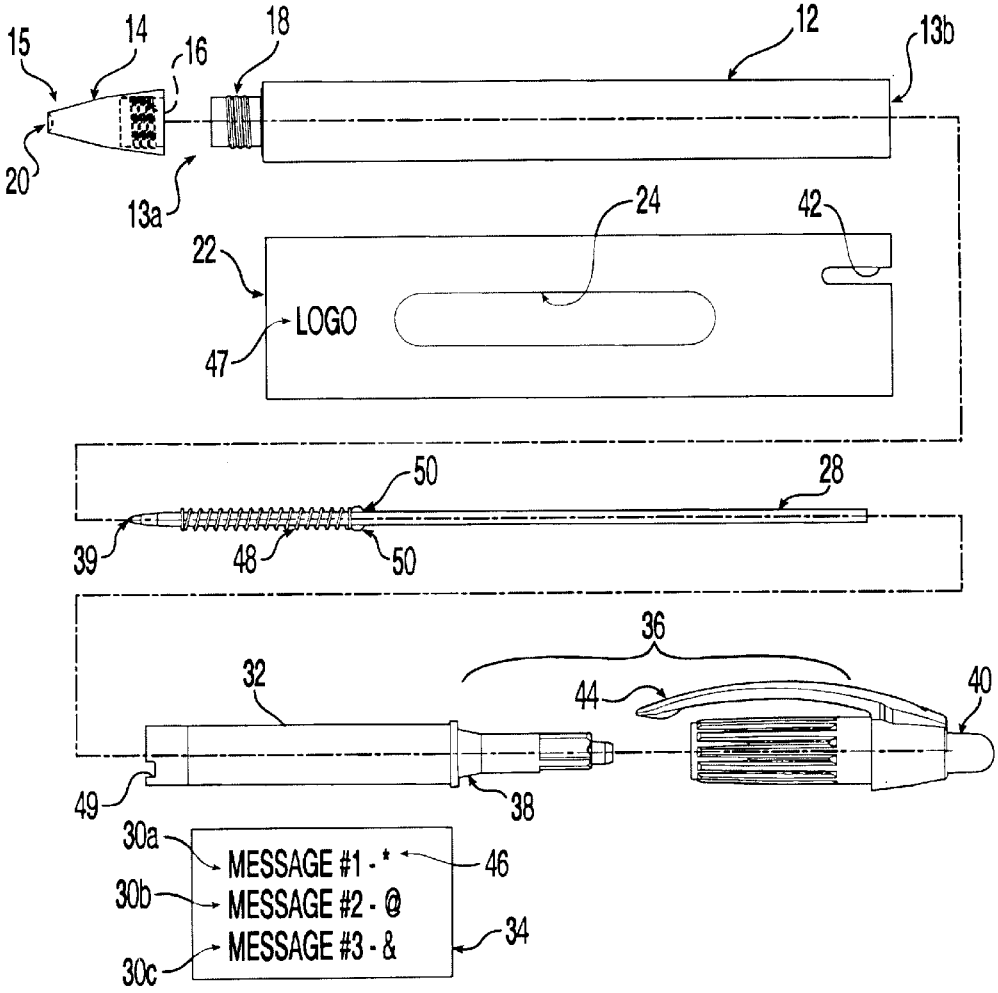
FIG. 4 is an exploded view of the writing instrument of FIG. 1.

In the embodiment shown in FIG. 4, body member 12 has a substantially cylindrical shape and is configured to receive writing element 28. In other embodiments, body member 12 may have a different shape. For example, in one embodiment, body member 12 may have a substantially conical shape. Alternative embodiments may comprise a body member 12 having a non-circular cross section. For example, body member 12 may have an elliptical, triangular, hexagonal, or otherwise non-circular cross section.

According to the present invention, and with reference to FIG. 4, a front nosepiece 14 may be attached to distal end 13*a* of body member 12 so that the interior of body member 12 is accessible for replacement of writing element 28 therein. In one embodiment, front nosepiece 14 is attached via threads 16 on front nosepiece 14 and complimentary threads 18 on body member 12. However, other manners of attaching front nosepiece 14 to body member 12 are within the scope of the present invention. For example, front nosepiece 14 may be attached to body member 12 via an adhesive, a press-fit connection, or other manners of connection. Alternatively, front nosepiece 14 may be formed into body member 12 such that front nosepiece 14 and body member 12 are one piece. With reference to FIG. 4, front nosepiece 14 has an aperture 20 at its distal writing end 15.

In accordance with the present invention, a wrap element 22 in the form of a sheet of material may be at least partially disposed around body member 12 via a wrapping process. Wrap element 22 may have a display opening 24 therein, formed, for example, by removing material from wrap element 22. Accordingly, wrap element 22 may be arranged about body member 12 such that display opening 24 overlays a transparent portion of body member 12 to form windowed portion 26. In some embodiments, multiple openings 24 may be provided in wrap element 22 to form multiple windowed portions 26 about body member 12.

Because display opening 24, in combination with a transparent portion of body member 12, forms windowed portion 26, the windowed portion 26 will exhibit the characteristics associated with the transparent portion of body member 12 and will not be affected by the wrap element 22. Windowed portion 26, therefore, will not be discolored by an inappropriately tinted transparent wrap element. Further, the view through windowed portion 26 will not be obstructed by air bubbles, which might be trapped under wrap element 22 if present. Moreover, the appearance of images displayed through windowed portion 26 will not be affected by distortion, which might otherwise be caused if windowed portion 26 were covered by a transparent wrap portion. As a result, the difference in the indices of refraction of the wrap element material and the body member material will not affect the appearance of images displayed through windowed portion 26.

A display member 32 may be mounted inside body member 12 and viewable through one or more windowed portions 26. Display member 32 may be formed from any of a variety of materials. For example, display member 32 may be formed from a material that is translucent, transparent, semi-transparent, or opaque.

Figure 2:
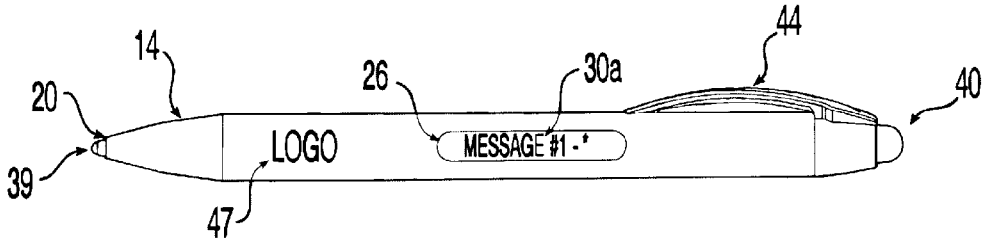
FIG. 2 is a side elevational view of the writing instrument of FIG. 1, wherein a first visual image is shown through the display window, and the writing element is in a writing position.
Figure 5:
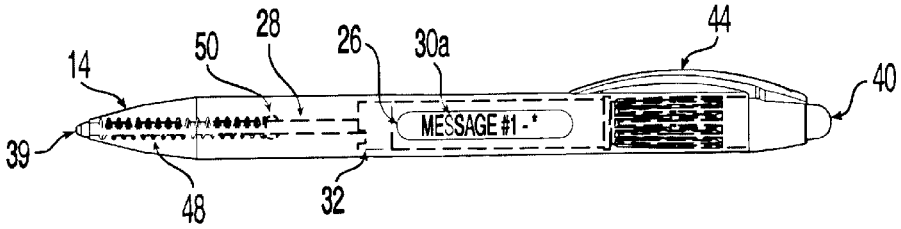
FIG. 5 is a view of the writing instrument of FIG. 1 further illustrating the internal structure of the writing instrument in phantom.
Figure 7:
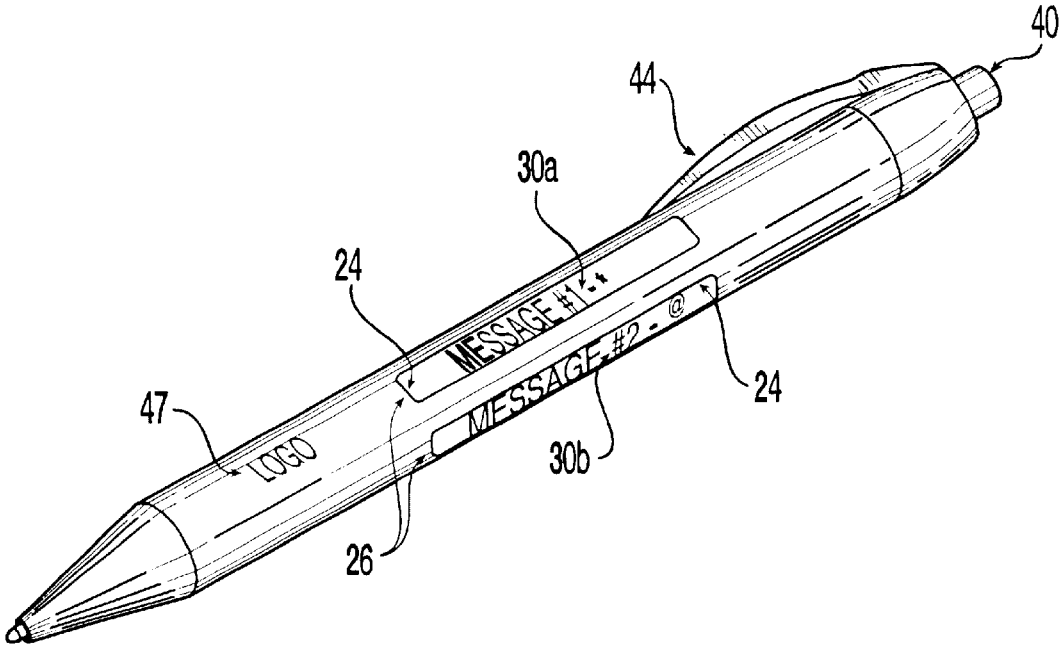
FIG. 7 is a perspective view of a writing instrument formed in accordance with the present invention and having multiple windowed sections.

In one embodiment, display member 32 may have one or more visual images 30*a*, 30*b*, 30*c*, such as text, drawings, or other indicia, disposed about its outer surface. As shown in FIGS. 2 and 5, visual images 30*a*, 30*b*, 30*c* may be configured and disposed about display member 32 with proper spacing and alignment such that at least one of the visual images 30*a*, 30*b*, 30*c*, or a portion thereof, shows through windowed portion 26. As shown in FIG. 7, alternative embodiments of writing instrument 10 may comprise multiple windowed portions 26. In such embodiments, display member 32 and visual images 30*a*, 30*b*, 30*c* may be configured and aligned to show at least one visual image 30*a*, 30*b*, 30*c*, or a portion thereof, through each, or at least more than one, of the multiple windowed portions 26.

In one embodiment, visual images 30*a*, 30*b*, 30*c* may be provided on a sheet of material disposed on a display member 32. For example, in the embodiment shown in FIG. 4, a display sheet 34, having visual images 30*a*, 30*b*, 30*c* printed thereon, is disposed or wrapped about the outer surface of display member 32. Display member 32 may be mounted inside body member 12 such that at least a portion of one or more images 30*a*, 30*b*, 30*c* on display sheet 34 shows through windowed portion 26. In other embodiments, one or more visual images 30*a*, 30*b*, 30*c* may be directly disposed on display member 32. For example, a rotary screen printing process may be used to print one or more images 30*a*, 30*b*, 30*c* directly on the outer surface of display member 32. In one embodiment, a 360° rotary screen printing process may be used to print one or more images directly about the outer surface of display member 32. In a further embodiment, any number of images, for example six images, may be printed about the outer surface of display member 32.

In accordance with the present invention, if desired, a display member 32 may be formed from a transparent material. Moreover, display member 32 may have one or more visual images 30*a*, 30*b*, 30*c* provided thereon. For example, one or more visual images 30*a*, 30*b*, 30*c* may be printed directly about the outer surface of a transparent display member 32 (such as in the above-described manner). Alternatively, a transparent display sheet 34 may be disposed about the outer surface of display member 32. The transparent display sheet 34 may have one or more visual images 30*a*, 30*b*, 30*c* printed thereon. It should be appreciated that the use of a transparent display member 32 also permits visual images 30*a*, 30*b*, 30*c* to be provided within and viewed through display member 32. Moreover, colored or opaque sections may be formed in an otherwise transparent display member 32 to serve as visual images 30*a*, 30*b*, 30*c*. For instance, the transparent material of the display member 32 may include dyed segments forming a pattern or image to be viewed through windowed portion 26. Thus, the use of a transparent display member 32 provides an interesting display for a user of the writing instrument 10. For example, a user may be able to look into windowed portion 26 and to see one or more images disposed about display member 32. In addition, the user would be able to see through the surface of display member 32 due to the transparency of display member 32. Thus, if writing element 28 is disposed inside display member 32, the user would be able to see writing element 28 in addition to one or more visual images disposed about display member 32. The amount of ink left in writing element 28, if writing element 28 is an ink tube, may thus be ascertained.

In an alternative embodiment of the present invention, one or more visual images 30*a*, 30*b*, 30*c* may be provided by a display member 32 having three-dimensional figures formed thereon. For example, the outer surface of display member 32 may be formed in the shape of a figurine. It should be appreciated that a variety of colors or textures may be used in creating either two-dimensional or three-dimensional visual images 30*a*, 30*b*, 30*c*. Moreover, it should be appreciated that display member 32 may provide visual images in various other ways.

Other embodiments of the present invention may use writing element 28 as the display member 32, wherein visual images 30*a*, 30*b*, 30*c* may be disposed about the outer surface of writing element 28. The visual images may be disposed directly on the outer surface of writing element 28, or the visual images may be disposed on a display sheet 34, which may be positioned about writing element 28.

Display member 32 may be fixedly mounted inside body member 12 so that the position of display member 32 is fixed with respect to windowed portion 26. Alternatively, display member 32 may be movably mounted inside body member 12 so that the images displayed through windowed portion 26 may be varied by moving display member 32 with respect to windowed portion 26. It should be appreciated that a writing instrument in accordance with the present invention may provide a single visual image 30*a* disposed on display member 32, wherein different portions of the visual image are displayed through windowed portion 26 upon advancement of display member 32. Alternatively, a writing instrument in accordance with the present invention may provide multiple visual images 30*a*, 30*b*, 30*c* disposed on display member 32 wherein different visual images are displayed through windowed portion 26 upon advancement of display member 32.

In an embodiment in which display member 32 is movably mounted inside body member 12, display member 32 may be rotatably mounted inside body member 12 so that when display member 32 is rotated, visual images 30*a*, 30*b*, 30*c* rotate therewith. Accordingly, the images displayed through windowed portion 26 may be varied by rotating display member 32. For example, a plurality of visual images 30*a*, 30*b*, 30*c* may be disposed and arranged on display member 32 such that movement of display member 32 with respect to windowed portion 26 causes successive visual images, or portions thereof, to show through windowed portion 26. Moreover, when writing instrument 10 comprises multiple windowed portions 26, visual images 30*a*, 30*b*, 30*c* may be configured and disposed about display member 32 with proper spacing and alignment such that when display member 32 is rotated, visual images 30*a*, 30*b*, 30*c* properly align with one or more windowed portions 26.

In accordance with one aspect of the present invention, an advancing mechanism may be provided for moving display member 32 with respect to windowed portion 26. For example, display member 32 may be associated or coupled with an advancing mechanism such that display member 32 is moved with respect to windowed portion 26 upon activation of the advancing mechanism. In one embodiment, when the advancing mechanism is activated, display member 32 will be moved longitudinally either toward distal end 13*a* or away from distal end 13*a* so that the images displayed through windowed portion 26 are longitudinally advanced.

In another embodiment, when the advancing mechanism is activated, display member 32 will be rotated thereby so that the images displayed through windowed portion 26 are rotatably advanced. Display member 32 may be configured and arranged to rotate continually in the same direction upon successive activation of the advancing mechanism. Alternatively, the advancing mechanism and display member 32 may be configured and arranged such that display member 32 rotates in one direction upon a first activation of the advancing mechanism, and display member 32 rotates in the opposite direction upon further activation of the advancing mechanism. It will be appreciated that the advancing mechanism may be in any form appropriate to the invention, as known and available to those skilled in the art, such as a slide mechanism or knob accessible to a user but operatively associated with display member 32.

Figure 1:
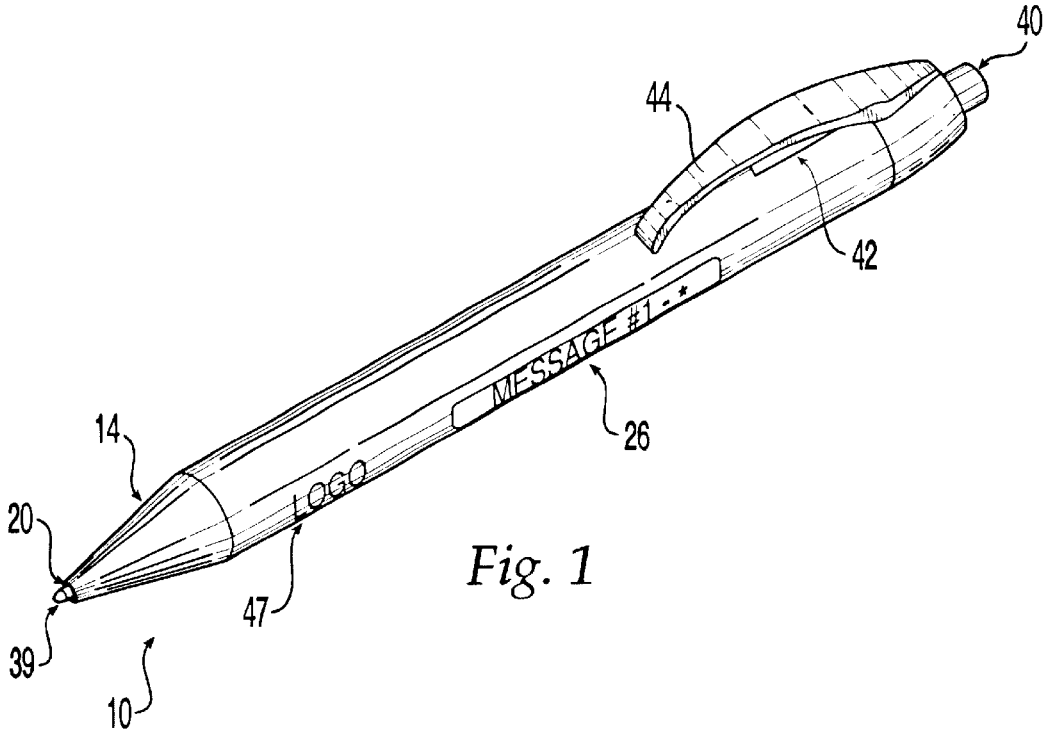
FIG. 1 is a perspective view of a writing instrument formed in accordance with the present invention.

The embodiments shown in FIGS. 1 and 2 each have a writing element 28 at least partially disposed inside body member 12. Writing element 28 has a marking end 39, which may be configured and disposed to be projectable through aperture 20 so that writing element 28 may be moved into and out of a writing position. FIG. 2 illustrates writing instrument 10 with writing element 28 in a writing position, wherein marking end 39 of writing element 28 is projected out of aperture 20. A biasing element 48 may be arranged inside body member 12 to bias writing element 28 toward a retracted position. For instance, as shown in FIG. 4, biasing element 48 may comprise a spring element positioned to apply a force to spring stops 50 on writing element 28. Thereby, writing element 28 may be biased into body member 12, such as toward an actuating mechanism 36, which generally serves to move writing element 28 into and out of a writing position (the operation of actuating mechanism 36 is discussed in greater detail herein below). With reference to FIG. 4, actuating mechanism 36 may be provided at proximal end 13*b* of body member 12. Actuating mechanism 36 may have a clip 44 mounted thereon.

As described above, an advancing mechanism may be configured and arranged to move display member 32 with respect to windowed portion 26. In one embodiment, actuating mechanism 36 may serve as the advancing mechanism. In another embodiment, actuating mechanism 36 may engage the advancing mechanism such that when actuating mechanism 36 is activated, actuating mechanism 36 will activate the advancing mechanism. However, it should be appreciated that display member 32 may be configured and arranged to move independently of such an actuating mechanism 36 whether or not a separate advancing mechanism is used. In the embodiment shown in FIG. 4, an advancing and actuating mechanism 36 is activated by pressing and releasing button 40. Therefore, when button 40 is pressed and released, actuating mechanism 36 moves display member 32 with respect to windowed portion 26, and actuating mechanism 36 moves writing element 28 into or out of a writing position. However, other forms of actuating mechanisms known to those skilled in the art may be used, such as those not requiring the pushing of a button.

Figure 3:
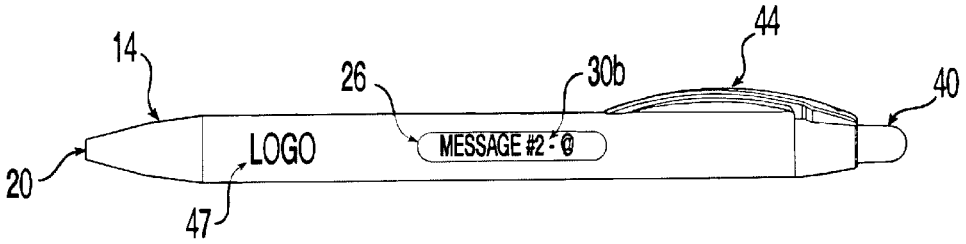
FIG. 3 is a side elevational view similar to that of FIG. 2, but with a second visual image shown through the display window and with the writing element retracted into the body member.

In one embodiment of the present invention, visual images 30*a*, 30*b*, 30*c* are disposed and arranged on display member 32 such that successive activation of actuating mechanism 36 causes successive visual images to show through windowed portion 26 of body member 12. For example, as illustrated by FIGS. 2 and 3, when actuating mechanism 36 is activated a first time, marking end 39 of writing element 28 projects through aperture 20 to a writing position, and display member 32 rotates to show a first visual image 30*a* through windowed portion 26 (see FIG. 2). Further activation of actuating mechanism 36 retracts marking end 39 back into body member 12 and rotates display member 32 to show a second visual image 30*b* through windowed portion 26 (see FIG. 3).

Actuating mechanism 36 may have one or more rotating members therein. In one embodiment, activation of actuating mechanism 36 rotates ratchet member 38 of actuating mechanism 36. As is known by one skilled in the art, ratchet member 38 may be configured and arranged to rotate continually in the same direction upon successive activation of actuating mechanism 36. Alternatively, ratchet member 38 may be rotated in some other manner. For example, ratchet member 38 may be rotatably advanced in a reciprocating manner, wherein ratchet member 38 is rotated in one direction upon a first activation of actuating mechanism 36, and ratchet member 38 is rotated in the opposite direction upon further activation of actuating mechanism 36.

In the illustrated exemplary embodiment of the present invention, actuating mechanism 36 has a rotatable ratchet member 38, and actuating mechanism 36 is configured and arranged to serve as the advancing mechanism. In such an embodiment, display member 32 may be configured to rotate with ratchet member 38. For example, display member 32 may be press fit into ratchet member 38. In another embodiment, display member 32 and ratchet member 38 may be formed of one piece. One embodiment of display member 32 is illustrated in FIG. 4, wherein ratchet member 38 of the advancing and actuating mechanism 36 is extended toward front nosepiece 14 to form display member 32. The extension of ratchet member 38 to form display member 32 reduces the number of components necessary for the operation of writing instrument 10 and may enhance the structural stability of display member 32 with respect to actuating mechanism 36.

One skilled in the art will recognize that many different types and kinds of actuating mechanisms may be used for moving writing element 28 into and out of a writing position. For example, U.S. Pat. No. 4,991,988, issued to Snell et al., which is incorporated by reference in its entirety herein, describes one type of actuating mechanism for projecting and retracting a writing element into and out of a writing position. One skilled in the art will recognize that other types and kinds of actuating mechanisms may also be used with the present invention, as the invention is not limited to use with only one type of actuating mechanism. For example, the following United States patents, all of which are incorporated by reference in their entirety herein, disclose various types of actuating mechanisms that may be used with the present invention: U.S. Pat. No. 6,227,734, issued to Kageyama et al.; U.S. Pat. No. 5,145,272 to Keil; U.S. Pat. No. 4,343,559 to Silver; U.S. Pat. No. 3,558,234 to Kranich; U.S. Pat. No. 3,427,113 to Bourbon; and U.S. Pat. No. 3,196,839 to Bertoglio et al. It should be appreciated that the above-referenced United States patents do not constitute a full and complete list of the types and kinds of actuating mechanisms which may be used with the present invention. As stated above, these and other different types and kinds of actuating mechanisms may be used with the present invention.

When actuating mechanisms of other types and kinds are used with the present invention, including, but not limited to, those discussed in the above-referenced United States patents, display member 32 may be coupled with the actuating mechanism in any desired manner understandable to one of ordinary skill in the art. Thereby, movement of the display member may be configured and arranged to correspond with movement of the actuating mechanism or movement of the writing element. Thus, activation of the actuating mechanism will move the display member and will, therefore, vary the visual image shown through windowed portion 26.

In one embodiment of the present invention, the actuating mechanism may be configured and arranged to be manually rotatable by a user. For example, the actuating mechanism may be continuously rotatable in either direction by the user. Thereby, the writing element may be continuously advanced in a forward or rearward direction depending on the direction of rotation of the actuating mechanism. In such an embodiment, the display member may be associated with the actuating mechanism so that the display member rotates with the actuating mechanism to vary the visual image shown through windowed portion 26.

In alternative embodiments of the present invention, a non-rotating actuating mechanism may be used to move writing element 28 into and out of a writing position. When a non-rotating actuating mechanism is used, the display member may be movably coupled to the actuating mechanism such that the display member moves in an appropriate manner, according to the movement of the actuating mechanism or the movement of the writing element. Thereby, the visual image shown through windowed portion 26 will be varied. For example, if the actuating mechanism reciprocates between a forward position (as when writing element 28 is in a writing position) and a rearward position (as when writing element 28 is in a retracted position), the display member may accordingly be configured and arranged to move between a forward position and a rearward position. When the display member is in a forward position, for example, a first visual image located on the display member may be shown through windowed portion 26. When the display member is retracted to a rearward position, the visual image shown through windowed portion 26 may be varied accordingly.

In a further embodiment of the present invention, as mentioned above, the advancing mechanism may simply function to move display member 32 with respect to windowed portion 26. In such an embodiment, the advancing mechanism may be configured and arranged so that activation of the advancing mechanism does not affect the movement of writing element 28 into and out of a writing position. Thus, activation of the advancing mechanism would move display member 32 with respect to windowed portion 26 but would not move writing element 28 into or out of a writing position. It should be appreciated that the above-described movements of the display member and an actuating mechanism are applicable to movements of the display member and the advancing mechanism.

As described above, the embodiment of FIG. 4 provides a wrap element 22 having a display opening 24, such as a hole, therein for forming windowed portion 26. Although display opening 24 is illustrated as a rectangular hole in FIGS. 1, 6, and 7, display opening 24 may take on a different configuration, such as a circle, triangle, ellipse, or other shape. Accordingly, display opening 24 may be shaped and otherwise configured and disposed about body member 12 to complement the image displayed through windowed portion 26. It should be appreciated that display opening 24 may be created by various types of material removal processes. For example, in one embodiment, display opening 24 may be die cut from wrap element 22. Of course wrap element 22 may be formed with a predetermined shape incorporating an opening or cutaway section defining display opening 24.

In the embodiment of FIG. 4, body member 12 has a generally cylindrical configuration, and wrap element 22 is a sheet of thin flexible material having a generally rectangular configuration. Therefore, the configuration of wrap element 22, when applied to body member 12 via a wrapping process, will complement the configuration of body member 12. As discussed above, however, body member 12 may comprise various shapes and cross-sectional areas. Accordingly, wrap element 22 may be appropriately shaped and configured to complement the shape and configuration of body member 12. However, it should be appreciated that wrap element 22 need not be shaped and configured to complement the shape and configuration of body member 12. Instead, wrap element 22 may be configured and arranged for other types of visual effects.

Various types and kinds of materials known in the art may be used to form wrap element 22. For example, wrap element 22 may comprise a planar flexible material for wrapping around body member 12. In one embodiment, wrap element 22 may comprise a sheet of thin paper, plastic, or foil. The sheet may be wrapped around body member 12 such that the free edges of the sheet abut each other. For example, wrap element 22 shown in FIG. 4 may be wrapped around body member 12 such that the top and bottom edges of wrap element 22 abut each other. In an alternative embodiment, the free edges of wrap element 22 may overlap each other. In a further alternative embodiment, wrap element 22 may be wrapped around body member 12 such that the free edges of wrap element 22 do not abut or overlap; rather, the edges will not meet, and a gap may be formed between the free edges of wrap element 22.

Figure 8:
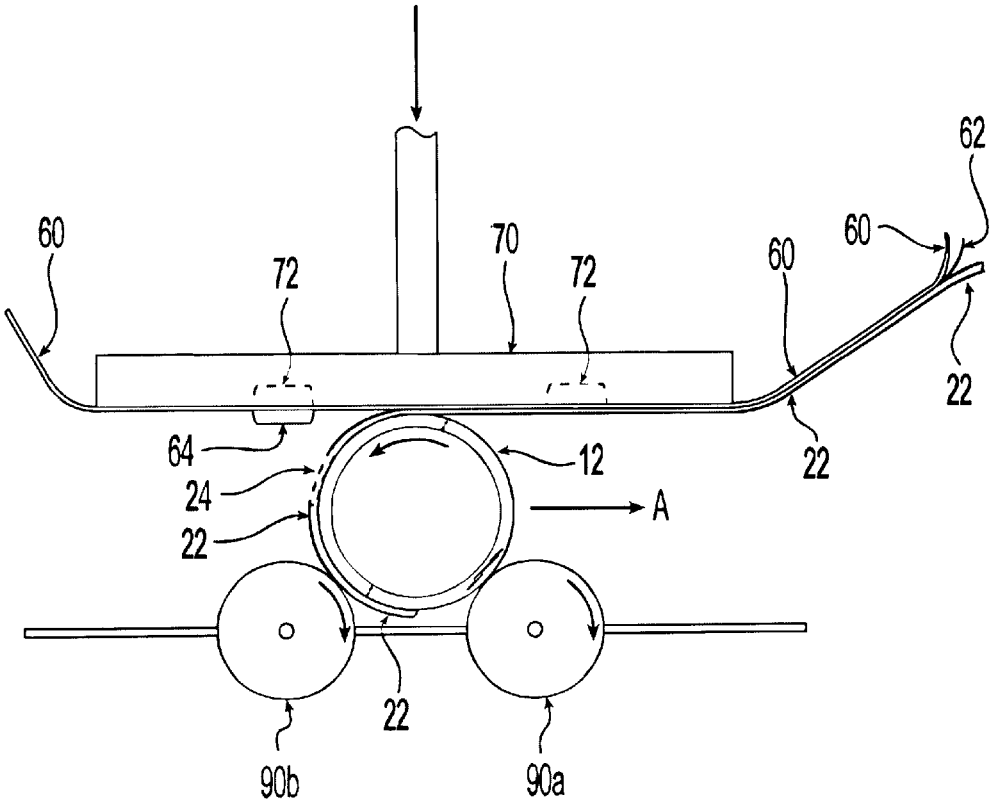
FIG. 8 is a perspective view of a wrapping process performed in accordance with the present invention.

In accordance with the present invention, and as illustrated in FIG. 8, wrap element 22 may comprise a thin sheet of wrap material that is transferred from the surface of a flexible carrier element 60 to the surface of body member 12 in a mass production assembly line. For example, a thin, continuous sheet of wrap material 22 comprising one or more layers may be releasably disposed on one side of a flexible carrier element 60. In one embodiment, the sheet of wrap material 22 may comprise a layer of non-transparent or translucent material and a layer of adhesive for adhering wrap material 22 to a writing instrument. In addition, a thin layer of release material 62 may be disposed between the sheet of wrap material 22 and carrier element 60.

As illustrated in FIG. 8, the sheet of wrap material 22 may be transferred from the flexible carrier element 60 to the surface of body member 12 via a heated and pressurized wrapping process. For example, carrier element 60 and a sheet of wrap material 22 may be positioned adhesive-side-down under a heated die 70. Die 70 heats carrier element 60 and the sheet of wrap material 22 and presses the adhesive side of the sheet of wrap material 22 against the outer surface of a cylindrical body member 12 that is passed underneath die 70. Body member 12 may be supported by rollers 90*a*, 90*b* and passed underneath die 70 from left to right in the direction of arrow A shown in FIG. 8. As body member 12 is moved under die 70, body member 12 rotates with rollers 90*a*, 90*b*, and the continuous sheet of wrap material 22 is released from carrier element 60 and adhered to the surface of body member 12. When body member 12 rolls out from under die 70, carrier element 60 may be advanced so that a new sheet of wrap material 22 is positioned under die 70.

In one wrapping process performed in accordance with the present invention, die 70 may have at least one die cavity 72 formed on its outer surface for stamping a portion of material out of the sheet of wrap material 22 as the sheet of wrap material 22 is applied to body member 12. For example, as body member 12 is passed under die 70, a die cavity 72 periodically is positioned between die 70 and body member 12. When die cavity 72 is so positioned, the pressure and heat applied to carrier element 60 and the sheet of wrap material 22 by die 70 is diminished at the portion of carrier element 60 disposed between die cavity 72 and body member 12. As a result, the portion 64 of wrap material disposed between die cavity 72 and the surface of body member 12 is not released from carrier element 60 and is not adhered to the surface of body member 12. This unreleased portion 64 of wrap material, therefore, remains on carrier element 60 and is removed from the otherwise continuous sheet of wrap material 22 that is transferred to body member 12. Moreover, a corresponding opening 24 is formed in the sheet of wrap material 22 that is transferred to body member 12.

In accordance with the present invention, a generally opaque wrap element 22 may be configured and disposed to hide certain portions of body member 12 while leaving other portions of body member 12 exposed. Therefore, if writing instrument 10 comprises a transparent body member 12, certain internal components of writing instrument 10 may be hidden from view while other internal components are exposed to view. For example, if wrap element 22 has a display opening 24 therein and is otherwise generally opaque, wrap element 22 may be configured and arranged to cover body member 12 such that only display member 32 may be seen through display opening 24. Accordingly, certain internal components of writing instrument 10, such as writing element 28 or biasing element 48, may be hidden from view.

In accordance with another independent aspect of the present invention, wrap element 22 may be configured and disposed to hide all of the internal components and structure of writing instrument 10. For example, if wrap element 22 does not have a display opening 24 therein, wrap element 22 may be configured and arranged about the entire length of body member 12 such that all of the internal components of writing instrument 10 are hidden from view.

Wrap element 22 may have various external appearances. For example, wrap element 22 may have a single-color opaque appearance. Alternatively, wrap element 22 may have a pattern, message, visual display, or some other design thereon. Moreover, wrap element 22 may provide various colors, textures, surfaces, pictures, or images 47. In some embodiments, wrap element 22 may be translucent, transparent, or semi-transparent. In a further embodiment, wrap element 22 may comprise a metallic foil. Wrap element 22 may be designed and applied to mimic the appearance of a generally opaque body member 12. For example, applying wrap element 22 to an otherwise transparent body member 12 may create the appearance that body member 12 is actually composed of an opaque material rather than a transparent material.

It should be appreciated that wrap element 22 may be applied to body member 12 in various ways. In one embodiment, wrap element 22 may be fixedly attached to body member 12. For example, wrap element 22 may be adhesively bonded to body member 12 so that the position of windowed portion 26 remains fixed with respect to certain other features and components of writing instrument 10. In a preferred embodiment, a heat transfer process may be used to transfer wrap element 22 to the outer surface of body member 12. Such a heat transfer process may activate adhesive disposed on wrap element 22 to cause wrap element 22 to adhere to body member 12.

In accordance with another independent aspect of the present invention, a writing instrument may be provided with a locating mark configured to assist in assembly of the components of the writing instrument. The locating mark may be disposed according to a predetermined positional relationship with respect to at least one feature or component of writing instrument 10. Such locating mark is useful for alignment of the various components of writing instrument 10. For instance, a locating mark may be used to align visual images 30*a*, 30*b*, 30*c* and windowed portion 26 with one another. Additionally, or alternatively, a locating mark may be used to align windowed portion 26 with respect to a component of writing instrument 10, such as clip 44. It will be appreciated that a locating mark may be used for aligning any type of element or component or feature of writing instrument 10 with respect to another element or component or feature of writing instrument 10.

As shown in FIGS. 1 and 4, wrap element 22 may be provided with a locating stripe or mark 42 (referenced herein as a wrap locating mark 42 for the sake of convenience and without intent to limit such feature to any particular form or configuration) formed thereon. As indicated in the figures, wrap locating mark 42 may comprise an opening, such as a hole or slot, in wrap element 22. In one method of forming and utilizing wrap locating mark 42, material is removed from wrap element 22, via a die cutting process (such as described above) or other material-removal process, to form wrap locating mark 42. Alternatively, wrap element 22 may be otherwise marked to form a wrap locating mark 42 on wrap element 22. For instance, wrap locating mark 42 may be formed by screen printing or by otherwise effecting a detectable trace, impression, notch, line, spot, or other mark onto wrap element 22.

Wrap locating mark 42 may be used to dispose wrap element 22 over body member 12 in a desired positional relationship with respect to at least one element or component or feature of writing instrument 10 during assembly. Wrap locating mark 42 may be used alone or in combination with an automatic placement device or an assembly mechanism, such as a photo-electric eye or a manual or automated detection or assembly device, to facilitate accurate, efficient placement of components and features about writing instrument 10. For example, wrap locating mark 42 may be used, during the assembly process or thereafter, for properly disposing display opening 24 with respect to visual images 30*a*, 30*b*, 30*c* displayed therein. For instance, positioning of wrap locating mark 42 with respect to an element, component, or feature (hereinafter "component" for the sake of convenience, without any intent to limit) of writing instrument 10 and positioning of visual images 30*a*, 30*b*, 30*c* with respect to such component, as well, results in proper alignment of display opening 24 and visual images 30*a*, 30*b*, 30*c*. In one embodiment, such alignment may be achieved by aligning visual images 30*a*, 30*b*, 30*c* with respect to actuating mechanism 36, and aligning wrap locating mark 42 with respect to display opening 24 and with respect to actuating mechanism 36 such that display opening 24 and visual images 30*a*, 30*b*, 30*c* are thereby aligned with respect to one another. Such alignment of wrap locating mark 42 with respect to actuating mechanism 36 may be achieved by alignment of wrap locating mark 42 with clip 44 when clip 44 is aligned in a set position with respect to actuating mechanism 36. Of course, other types of alignments through the use of wrap locating mark 42 are within the scope of the present invention. For instance, alignment of wrap locating mark 42 may be with respect to clip 44 alone when an actuating mechanism is not provided, or with respect to actuating mechanism 36 alone when a clip is not provided.

Even if alignment with an internal element, such as display member 32 or visual images 30*a*, 30*b*, 30*c* is not desired or necessary, wrap locating mark 42 may nonetheless be disposed on wrap element 22 to establish a predetermined positional relationship between any other feature of wrap element 22 (i.e., not necessarily a display opening 24, but alternatively other markings on wrap element 22) and a component of writing instrument 10, such as clip 44 (which might otherwise interfere with viewing of the desired feature on wrap element 22). For example, wrap locating mark 42 may be disposed on wrap element 22 in a predetermined position away from display opening 24 (or a marking on wrap element 22). Thereafter, wrap element 22 may be applied to body member 12. Subsequently, clip 44 may be disposed on body member 12 such that clip 44 is located over wrap locating mark 42, as illustrated in FIG. 1. This method of disposing wrap locating mark 42 with respect to display opening 24 and clip 44 facilitates accurate placement of clip 44 with respect to display opening 24 to insure that clip 44 is mounted to body member 12 at a location where clip 44 does not obstruct the view of windowed portion 26. The same is true for any feature on wrap element 22 and any component of writing instrument 10.

In order to enhance alignment and/or to facilitate manufacture, wrap locating mark 42 and display opening 24 may be formed during the same die cutting process. For example, the same die may be configured to remove material from wrap element 22 to create both wrap locating mark 42 and display opening 24 during the same die cutting process. Such a method will ensure that wrap locating mark 42 and display opening 24 are positioned accurately with respect to each other. Such accurate placement of wrap locating mark 42 and display opening 24 with respect to each other may be greater than the placement accuracy otherwise obtained when wrap locating mark 42 and display opening 24 are created during separate processes. Moreover, the placement accuracy obtained when both wrap locating mark 42 and display opening 24 are formed during the same die cutting process may be greater than the placement accuracy obtained if wrap locating mark 42 and display opening 24 were formed during the same printing process.

As indicated above, wrap locating mark 42 may operate as an effective tool during the assembly of writing instrument 10. In one method of utilizing wrap locating mark 42, wrap locating mark 42 may be used in combination with a photo-electric eye device to enable accurate, efficient placement of the components of writing instrument 10. For example, after wrap locating mark 42 has been formed, wrap element 22 may be wrapped about body member 12. Thereafter, the wrapped body member 12 may be manipulated by an assembling device having a photo-electric eye incorporated therein. The assembling device may have a body-handling member configured and adapted for positioning the wrapped body member 12 longitudinally in the assembling device. Thereafter the body-handling member may rotate the wrapped body member until wrap locating mark 42 is appropriately aligned with the photo-electric eye. Subsequently, a pre-positioned clip 44, or some other feature or component of writing instrument 10, may be mounted on the appropriately aligned body member and in alignment with respect to wrap locating mark 42 so that wrap element 22, body member 12, and clip 44 (or some other designated feature or component) are properly positioned with respect to one another.

The above-described use of a locating mark need not be limited to use on a wrap element wrapped over a body member of the writing instrument. For instance, if visual images 30*a*, 30*b*, 30*c* are provided on a display sheet 34, an image locating mark 46 may be disposed on display sheet 34, as indicated in FIG. 4, to aid in aligning display sheet 34 with respect to display member 32. Alternatively, or additionally, a display locating mark 49 may be provided on display member 32 to aid in aligning display sheet 34 with respect to display member 32. Display member 32 may be positioned in predetermined alignment with body member 12, such that visual images 30*a*, 30*b*, 30*c* may be aligned with windowed portion 26 on body member 12, regardless of how windowed portion 26 is formed. In such an embodiment, image locating mark 46 may comprise an opening in display sheet 34 formed in any desired manner, such as described above with respect to wrap locating mark 42. Moreover, display locating mark 49 may be formed in any desired manner, such as by removing a portion of display member 32, e.g., by forming a notch or cutout at an end of display member 32, as illustrated in FIG. 4. As will be appreciated, visual images 30*a*, 30*b*, 30*c* may be aligned with display locating mark 49, whether they are directly printed on display member 32 or provided on a display sheet 34, to achieve the desired alignment of visual images 30*a*, 30*b*, 30*c* with display member 32 and the consequent desired alignment with other components of writing instrument 10 (such as windowed portion 26).

One manner in which the above-described inventive concepts may be applied in assembling a writing instrument will now be described. In the embodiment of FIG. 4, wrap element 22 has both a display opening 24 as well as a wrap locating mark 42 and is wrapped around body member 12, leaving wrap locating mark 42 in a position with which another component of writing instrument 10 may be aligned, such as clip 44, as described below. One or more visual images 30*a*, 30*b*, 30*c* are printed on display sheet 34. Display sheet 34 may then be applied to display member 32 by aligning image locating mark 46 (with which visual images 30*a*, 30*b*, 30*c* are aligned) with respect to display locating mark 49 on display member 32. Display member 32 is coupled in a predetermined positional relationship with respect to at least one of the components of writing instrument 10, such as actuating mechanism 36. Clip 44 may be assembled with actuating mechanism 36 such that clip 44 is disposed according to a predetermined positional relationship with respect to actuating mechanism 36. Subsequently, clip 44 (and thus actuating mechanism 36) may be assembled with body member 12 according to a predetermined positional relationship with respect to wrap locating mark 42 (and thus display opening 24). Accordingly, both visual images 30*a*, 30*b*, 30*c* and display opening 24 are properly positioned with respect to actuating mechanism 36 and clip 44, and thus to each other as well. Using such a method, one or more visual images 30*a*, 30*b*, 30*c* may be properly positioned with respect to display opening 24. Moreover, clip 44 may be positioned such that it does not interfere with viewing of visual images 30*a*, 30*b*, 30*c* through display opening 24.

According to another aspect of the present invention, as described above, wrap locating mark 42 may be used with a wrap element 22 that does not otherwise have a display opening 24 therein. That is, wrap element 22 may have a locating mark 42 thereon and not have a display opening 24 therein for creating a windowed portion 26. In such an embodiment, wrap locating mark 42 may be disposed on wrap element 22 to establish a predetermined positional relationship of wrap element 22 with respect to at least one feature or component of writing instrument 10, such as, for example, clip 44. Accordingly, clip 44, may properly be positioned with respect to visual image 47 imprinted on wrap element 22.

In an exemplary application of such use of wrap locating mark 42, wrap element 22 may first be applied to body member 12, and, subsequently, clip 44 may be applied to body member 12 according to a predetermined positional relationship. Alternatively, clip 44 and wrap element 22 may be applied to body member 12 in the opposite order. For example, clip 44 may be mounted on body member 12 before wrap element 22 is applied to body member 12. Thereafter, wrap element 22 may be applied to body member 12 such that wrap locating mark 42 is properly positioned according to the predetermined positional relationship with respect to clip 44. Wrap locating mark 42 may thus function to orient wrap element 22 with respect to at least one component of writing instrument 10.

It should be appreciated that the various features and components described herein may be used singly or in any combination thereof. For example, the windowed portion 26 feature and the wrap locating mark 42 feature each have their own independent functions and utility. Windowed portion 26 creates a transparent window section about a writing instrument 10 that provides advantages over prior art windows. Likewise, wrap locating mark 42 allows for greater accuracy and efficiency during assembly of writing instrument 10. As such, each feature may be used independently of each other. For example, a writing instrument may provide a wrap element 22 having a wrap locating mark 42 but not having a windowed portion 26. Alternatively, a writing instrument may provide a wrap element 22 having a windowed portion 26 but not having a wrap locating mark 42. Similarly, other features and components described herein may be used alone or in combination with other described features and components.

Thus, the present invention is not limited to only the embodiments specifically described herein. For example, it should be appreciated that other applications of the windowed portion 26 in addition to those described herein are also within the scope of the present invention. It should further be appreciated that other applications of wrap locating mark 42 in addition to than those described herein are also within the scope of the present invention. While the foregoing description and drawings may represent preferred embodiments of the present invention, it will be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, and proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A writing instrument comprising:

a body member having a first end and a second end, at least part of said body member between said first end and said second end being transparent, said body member being configured to receive a writing element inside said body member; and a wrap element having an opening therethrough;

wherein said wrap element is formed as a sheet of material fixedly wrapped around said body member such that said opening and said transparent part of said body member define a windowed portion of said writing instrument.

2. The writing instrument of claim 1, further comprising:

a display member disposed inside said body member, said display member having one or more visual images thereon;

wherein said display member is configured and disposed to show at least one of said one or more visual images through said windowed portion of said writing instrument.

3. The writing instrument of claim 2, wherein:

said display member is movable between successive positions to successively vary the position of said one or more visual images with respect to said windowed portion.

4. The writing instrument of claim 1, wherein said wrap element is adhesively bonded to said body member.

5. A writing instrument comprising:

more than one component; and a wrap element formed as a sheet of material fixedly wrapped around a first component of said writing instrument;

wherein:

a locating mark is defined by removing material from said wrap element; and a second component of said writing instrument is coupled to said first component according to a predetermined positional relationship with respect to said locating mark.

6. The writing instrument of claim 5, wherein:

said first component is a body member having a first end and a second end;

said body member is configured to receive a writing element therein; and said wrap element is disposed on said body member between said first end of said body member and said second end of said body member.

7. The writing instrument of claim 6, wherein said second component is a clip.

8. The writing instrument of claim 6, wherein:

at least part of said body member between said first end and said second end of said body member is transparent;

said wrap element has a display opening defined therethrough;

said wrap element is disposed on said body member such that said display opening and said transparent part of said body member define a windowed portion of said writing instrument; and both said locating mark and said display opening are formed by the same die cutting process.

9. A method for forming a writing instrument comprising a plurality of components including a body member, a windowed portion on said body member, and a first component within said body member, said first component or a visual image provided on said first component being viewable through said windowed portion, said method comprising:

aligning said first component with respect to a second component of said writing instrument according to a predetermined positional relationship between said first component and said second component, and fixedly coupling at least a portion of said second component with respect to said windowed portion according to a predetermined positional relationship between said second component and said windowed portion such that said windowed portion and said first component are aligned with respect to each other.

10. The method of claim 9, wherein:

at least one of said windowed portion and said first component is formed as a sheet of material, said sheet of material having a locating mark thereon; and said method further comprises using said locating mark to align said one of said windowed portion and said first component with respect to said second component of said writing instrument.

11. The method of claim 10, wherein said locating mark is formed by removing material from said sheet of material.

12. The method of claim 9, wherein:

said first component comprises a display member, said display member having at least one visual image thereon;

said second component comprises an advancing mechanism configured to move said display member with respect to said windowed portion; and said method comprises aligning said display member with respect to said advancing mechanism and aligning said advancing mechanism with respect to said windowed portion.

13. The method of claim 12, wherein:

said writing instrument further comprises a clip coupled to said advancing mechanism; and said aligning said advancing mechanism with respect to said windowed portion further comprises aligning said clip with respect to said windowed portion and with respect to said advancing mechanism, thereby aligning said windowed portion with respect to said visual image.

14. The method of claim 13, wherein:

said windowed portion is at least partially defined by a wrap element, said wrap element being in the form of a sheet of material, and said wrap element being wrapped around said body member;

a wrap locating mark is provided on said sheet of material; and said method further comprises aligning said clip with respect to said wrap locating mark.

15. The method of claim 12, wherein:

said visual image is provided on a display sheet, said display sheet comprising a sheet of material, and said display sheet being wrapped around said display member;

an image locating mark is provided on said display sheet; and said method further comprises aligning said image locating mark with respect to said display member.

16. The method of claim 15, wherein:

a display locating mark is provided on said display member; and said method further comprises aligning said image locating mark with respect to said display locating mark.

17. The method of claim 16, wherein said display locating mark is a notch in said display member.

18. The method of claim 12, wherein:

said visual image is provided on a display sheet, said display sheet comprising a sheet of material, and said display sheet being wrapped around said display member;

a display locating mark is provided on said display member; and said method further comprises aligning said display sheet with respect to said display locating mark.

19. The method of claim 9, wherein said windowed portion is at least partially defined by a wrap element, said wrap element comprising a sheet of material with a wrap locating mark provided thereon, said method further comprising:

wrapping said wrap element around said body member; and aligning said second component of said writing instrument with respect to said wrap locating mark.

20. A method for aligning a display member having at least one visual image thereon within a writing instrument body member and with respect to a windowed portion on said writing instrument body member, said method comprising:

coupling said display member to a writing instrument component so that said visual image is aligned with respect to said writing instrument component according to a predetermined positional relationship between said visual image and said writing instrument component;

inserting said display member in said body member; and fixedly coupling a portion of said writing instrument component with respect to said windowed portion according to a predetermined positional relationship between said writing instrument component and said windowed portion so that said visual image is aligned to show through said windowed portion so that said display member is aligned with said windowed portion to allow said visual image to show through said windowed portion.

21. The method of claim 20, further comprising:

providing a locating mark on said body member, said locating mark being disposed at a predetermined position with respect to said windowed portion; and aligning said writing instrument component with respect to said locating mark so that said visual image is aligned to show through said windowed portion.

22. The method of claim 20, wherein said writing instrument component is an advancing mechanism configured to move said display member with respect to said windowed portion, said method further comprising:

coupling a clip to said advancing mechanism at a predetermined position with respect to said advancing mechanism; and aligning said clip according to a predetermined positional relationship with respect to said windowed portion such that said visual image is aligned to show through said windowed portion and said clip does not block said windowed portion.

23. The method of claim 20, wherein said writing instrument component is an advancing mechanism configured to move said display member with respect to said windowed portion, said method further comprising:

aligning said advancing mechanism with respect to a clip and aligning said clip with respect to said windowed portion such that said windowed portion is aligned with respect to said visual image.

24. The method of claim 20, wherein said display member is provided with a display locating mark, said method further comprising aligning said visual image with respect to said display locating mark such that upon said coupling of said display member with said writing instrument component and upon aligning said writing instrument component with said windowed portion, said visual image is aligned with respect to said windowed portion.

25. The method of claim 24, wherein said visual image is provided on a display sheet formed of a sheet of material, said method further comprising aligning said display sheet with respect to said display locating mark.

26. The method of claim 25, wherein an image locating mark is provided on said display sheet and said visual image is disposed on said display sheet at a predetermined position with respect to said image locating mark, said method further comprising aligning said image locating mark with respect to said display locating mark.

27. The method of claim 20, wherein said window portion further comprises a window, and said display member is rotatable in a stepwise fashion with respect to said window, whereby said visual image is aligned with said window upon aligning said writing instrument component with said window.

28. A method for forming a windowed portion on a writing instrument, said writing instrument comprising a body member having a first end and a second end, at least part of said body member between said first end and said second end being transparent, said method comprising:

forming an opening in a sheet of wrap material; and fixedly wrapping said sheet of wrap material around said body member so that said opening and said transparent part of said body member define a windowed portion on said writing instrument.

29. The method of claim 28, wherein said opening is formed by a die stamping process.

30. The method of claim 29, wherein:

said sheet of wrap material comprises a layer of material releasably disposed on a carrier element; and said method further comprises transferring said sheet of wrap material from said carrier element to the outer surface of said body member via a pressurized wrapping process.

31. The method of claim 30, further comprising applying heat to said carrier element and said sheet of wrap material during said pressurized wrapping process.

32. A method for forming a writing instrument comprising a plurality of components including a body member, a windowed portion on said body member, and a first component within said body member, said first component or a visual image provided on said first component being viewable through said windowed portion, with at least one of said windowed portion and said first component being formed as a sheet of material, said sheet of material having a locating mark thereon, said method comprising:

aligning said first component with respect to a second component of said writing instrument according to a predetermined positional relationship between said first component and said second component;

aligning said second component with respect to said windowed portion according to a predetermined positional relationship between said second component and said windowed portion such that said windowed portion and said first component are aligned with respect to each other; and using said locating mark to align said one of said windowed portion and said first component with respect to said second component of said writing instrument.

33. A method for aligning a display member within a writing instrument body member and with respect to a windowed portion on said writing instrument body member, said display member having at least one visual image thereon and a display locating mark, said method comprising:

coupling said display member to a writing instrument component so that said visual image is aligned with respect to said writing instrument component according to a predetermined positional relationship between said visual image and said writing instrument component;

inserting said display member in said body member;

aligning said writing instrument component with respect to said windowed portion according to a predetermined positional relationship between said writing instrument component and said windowed portion so that said visual image is aligned to show through said windowed portion; and aligning said visual image with respect to said display locating mark such that upon said coupling of said display member with said writing instrument component and upon aligning said writing instrument component with said windowed portion, said visual image is aligned with respect to said windowed portion.

* * * * *